United States Patent [19]

Stoller

[11] 3,994,759

[45] Nov. 30, 1976

[54] NEEDLED NONWOVEN MATERIAL AND METHOD FOR MAKING SAME

[75] Inventor: Frederick L. Stoller, Greenville, S.C.

[73] Assignee: Phillips Petroleum Company, Bartlesville, Okla.

[22] Filed: Jan. 15, 1975

[21] Appl. No.: 541,085

Related U.S. Application Data

[63] Continuation-in-part of Ser. No. 57,809, July 23, 1970, abandoned.

[52] U.S. Cl. ..... 156/85; 28/72.17; 28/72.2 R; 156/148; 156/282; 156/324; 156/229; 156/306; 264/103; 264/126; 428/235; 428/297; 428/288; 428/300; 428/296

[51] Int. Cl.[2] ..... B29C 27/00; B32B 31/00

[58] Field of Search ..... 156/72, 84, 85, 148, 156/160, 164, 209, 229, 253, 282, 296, 306, 311, 324, 494; 28/72 NW, 72.2 R, 72.17; 264/103, 126, 257, 258, 291, 342 R, 342 RE; 428/152, 234, 235, 280, 288, 296, 297, 300, 365

[56] References Cited

UNITED STATES PATENTS

| | | | |
|---|---|---|---|
| 2,891,279 | 6/1959 | Neumann | 264/327 |
| 2,966,439 | 12/1960 | Sorel | 156/85 |
| 3,484,916 | 12/1969 | Johnstone | 28/72.2 R |
| 3,570,085 | 3/1971 | Heineman | 156/85 |
| 3,575,178 | 10/1970 | Parlin et al. | 156/148 |
| 3,622,422 | 11/1971 | Newman | 156/282 |
| 3,660,555 | 5/1972 | Rains et al. | 264/126 |
| 3,819,465 | 6/1974 | Parsons et al. | 156/84 |
| 3,837,995 | 9/1974 | Floden | 156/306 |

*Primary Examiner*—William A. Powell
*Assistant Examiner*—J. J. Gallagher

[57] ABSTRACT

Heat shrinkable fibers are laid down on a backing element, needle-punched and thereafter heated on one surface of the needle-punched fabric in a relaxed condition to a temperature to fuse at least a portion of the fibers adjacent the heated surface and shrink said fibers and first material surface relative to the opposed surface for providing a nonwoven material having a randomly uneven surface. In another embodiment, the backing element is eliminated.

8 Claims, No Drawings

NEEDLED NONWOVEN MATERIAL AND METHOD FOR MAKING SAME

This application is a continuation-in-part of copending application Ser. No. 57,809, filed July 23, 1970, now abandoned.

It is desirable to provide a nonwoven synthetic material having at least one surface that is randomly uneven and wrinkled. Heretofore methods for forming a material having an uneven wrinkled surface utilized embossing rolls, for example, to mechanically deform the surface of the material. This method caused the uneven surface of the resultant material to have a configuration which was repeated and uniform over the length of the material.

In one embodiment of this invention, a needlepunched material comprising heat shrinkable, crimped fibers such as polypropylene, for example, is heated on one surface in a substantially relaxed condition to a temperature sufficient to cause a portion of the fibers on the heated surface to fuse one to the other and said fibers and surface to shrink relative to the opposed surface. The resultant material of this invention has one surface that is relatively smooth and an opposed surface that is randomly uneven and wrinkled.

In one embodiment of the method of this invention, a material backing element such as, for example, a polypropylene film, polyester warp yarn, cheesecloth sheet, loosely woven nylon or fibrillatable material is provided. A multiplicity of synthetic crimped, heat shrinkable fibers are laid down on one surface of the backing element. The backing element and overlying fibers are then needlepunched for attachment of the fibers to the backing element. In the needlepunching operation, at least a portion of the fibers are driven through the surface of the backing to the underlying opposed surface of the backing. The needles utilized are of blunt, barbed or forked configurations adapted to contact portions of the fibers and move that fiber portion through the backing element as known in the art. It is preferred that the material be needlepunched at least 350 punches per square inch in order to subsequently form a sufficiently bonded material. In another embodiment, the backing element is eliminated.

The resultant needlepunched material is thereafter passed to a heating zone at which only one surface of the needlepunched material is heated and during said heating the material is necessarily maintained in a relaxed position. This relaxed position is maintained by maintaining slack in the material between the rolls and other apparatus and by not attaching lateral tension means to said material. In the heating zone, the temperature of the heated surface, for example, the first surface, of the needlepunched material is increased to a temperature sufficient to cause a portion of the fibers on the first surface to fuse one to the other and shrink said fibers and first surface relative to the second surface of the material. That temperature is dependent upon the composition of the fibers but should be sufficiently high to shrink the first surface in an amount to cause the desired degree of random warping and unevenness on the second surface of the material. Where a mixture of polypropylene and other 1-olefin fibers each having different shrink temperatures, for example, are employed, the temperature to produce a desirable degree of wrinkling and unevenness obviously varies directly relative to the volume ratio of higher shrink temperature fibers to lower shrink temperature fibers. The fusion of a portion of the fibers on the first surface also causes the material to be formed into a unitary sheet and maintain the fibers in their needlepunched position relative to the backing element. For example, where polypropylene fibers are used the temperature will be about 325°–375° F.

The heating of one surface of the needlepunched material can be accomplished by, for example, providing a pair of rollers on both sides of the needlepunched material, heating only one of the rollers, and passing the needlepunched material through the nip of the rollers with the first surface of the material in contact with the heated roller. Other surface heating methods known in the art can be utilized. Also with needlepunched material or relatively small thickness, it sometimes is desirable to cool the opposed second surface of the material during heating of one surface in order to produce the desired shrinkage of the first surface.

For further adhering the fibers to the backing and providing a more sturdy resultant material, the material discharging from the heating means can be passed in a tensioned condition to a second heating means for heating of the uneven second surface of the material to a temperature sufficient to fuse one to another at least a portion of the fibers on the uneven surface. By placing the material in a tensioned condition during heating of the uneven surface, further warping and the production of additional surface unevenness is prevented. Tension can be imparted to the material by contacting the material with tension means such as dancer rolls.

An example of the method of this invention is as follows:

Fibers — Polypropylene fibers crimped, 4-1/2 denier, 4 inches cut length.

Polypropylene backing element uniaxially oriented.

Amount of fibers - 4½ oz./sq. yd. fibrillatable polypropylene fiber, thickness 0.75 mil.

Fibers needlepunched 400 total punches per square inch.

Temperature of surface during heating was 350° F. which contacted the film side of the needled batt.

Polypropylene, nylon, other 1-olefin fibers, any synthetic fibers which shrink at a temperature less than the temperature at which any portion of the composite fabric is damaged, and mixtures thereof can be utilized with this invention.

The resultant material had a relatively smooth surface with at least a portion of the fibers adjacent one surface being fused one to the other and the opposed surface being randomly uneven.

In another embodiment of this invention, the backing element is eliminated. The fibers are laid down in the form of a batt which is moved into the needles by any suitable conveying means, such as feed rolls for example. The batt can be formed by the use of cross-lappers. Except for the fact that the batt is not supported by a backing element, the process is the same.

Other modifications and alterations of this invention will become apparent to those skilled in the art from the foregoing discussion and example, and it should be understood that this invention is not to be unduly limited thereto.

What is claimed is:

1. A method for forming a material, comprising:

laying down a multiplicity of synthetic heat shrinkable fibers on one surface of a backing material;

needlepunching at least a portion of the fibers through the backing element;

heating only one surface of the resultant material while maintaining said material in a relaxed condition, said heated surface being heated to a temperature sufficient to cause a portion of the fibers on the heated surface to fuse one to the others and shrink said heated surface relative to the opposed surface of the material for providing a unitary material having an even surface and a warped, randomly uneven opposed surface;

thereafter placing the material under tension and heating the uneven surface of the material to a temperature sufficient to fuse one to the other at least a portion of the fibers adjacent the uneven surface.

2. A method, as set forth in claim 1, wherein the tension on the material during the heating of the uneven surface thereof is a tension sufficient to prevent further warping of the material during the heating of said second surface.

3. A material formed by the process of claim 1.

4. A method for forming a material, comprising:

laying down a multiplicity of synthetic heat shrinkable fibers to form a batt;

needlepunching the batt;

heating only one surface of the resultant material while maintaining said material in a relaxed condition, said heated surface being heated to a temperature sufficient to cause a portion of the fibers on the heated surface to fuse one to the others and shrink said heated surface relative to the opposed surface of the material for providing a unitary material having an even surface and a warped, randomly uneven opposed surface;

thereafter placing the material under tension and heating the uneven surface of the material to a temperature sufficient to fuse one to the other at least a portion of the fibers adjacent the uneven surface.

5. A method, as set forth in claim 4, wherein the tension on the material during the heating of the uneven surface thereof is a tension sufficient to prevent further warping of the material during the heating of said second surface.

6. A material formed by the process of claim 4.

7. A method, as set forth in claim 1, wherein the tension on the material during the heating of the uneven surface thereof is imparted to the material by contacting the material with dancer rolls.

8. A method, as set forth in claim 4, wherein the tension on the material during the heating of the uneven surface thereof is imparted to the material by contacting the material with dancer rolls.

* * * * *